US012460515B1

(12) United States Patent
Yee et al.

(10) Patent No.: US 12,460,515 B1
(45) Date of Patent: Nov. 4, 2025

(54) SEAL ARRANGEMENT FOR A LINER HANGER, METHOD, AND SYSTEM

(71) Applicant: Baker Hughes Oilfield Operations LLC, Houston, TX (US)

(72) Inventors: Chee Kong Yee, Katy, TX (US); Andy Tom, Cypress, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 0 days.

(21) Appl. No.: 18/787,292

(22) Filed: Jul. 29, 2024

(51) Int. Cl.
*E21B 43/10* (2006.01)

(52) U.S. Cl.
CPC ..... *E21B 43/103* (2013.01); *E21B 2200/01* (2020.05)

(58) Field of Classification Search
CPC ..... E21B 33/1208; E21B 33/1216
See application file for complete search history.

(56) References Cited

U.S. PATENT DOCUMENTS 5,333,692 A 8/1994 Baugh et al.
6,173,964 B1 * 1/2001 Bell ..... E21B 33/1216 277/572
6,598,677 B1 7/2003 Baugh et al.
7,360,592 B2 4/2008 McMahan
7,784,797 B2 8/2010 Baugh et al.
9,568,103 B2 2/2017 Gomez et al.
10,100,598 B2 10/2018 Stæhr
10,100,621 B2 10/2018 Hallundbæk et al.
11,118,434 B2 9/2021 Hazelip et al.
11,215,021 B2 1/2022 Givens et al.
11,761,290 B2 9/2023 Greci et al.
2010/0243276 A1 * 9/2010 King ..... E21B 33/1208 166/387
2016/0356131 A1 * 12/2016 Humphrey ..... E21B 43/08
2018/0171742 A1 * 6/2018 Hern ..... E21B 33/1208
2023/0407730 A1 12/2023 Zhong et al.

* cited by examiner

*Primary Examiner* — David Carroll
(74) *Attorney, Agent, or Firm* — Baker Hughes Patent Organization

(57) ABSTRACT

A seal arrangement for a liner hanger, including a seal ring, a lock ring adjacent the seal ring, the lock ring including a body configured to limit radial compression of the seal ring, a wing extending from the body in an axial direction of the body, and a shoulder defined by the body, the shoulder complementary to a lock member. A method for assembling a seal arrangement, including positioning a lock ring on a tubular, positioning a seal ring on the tubular, repeating the positioning of a lock ring and the positioning of the seal ring until a selected number of lock rings and seal rings are alternatingly disposed on the tubular, and feeding a lock wire through a lock wire window to engage the tubular and the lock ring to retain the lock ring axially to the tubular.

16 Claims, 9 Drawing Sheets

SEAL ARRANGEMENT FOR A LINER HANGER, METHOD, AND SYSTEM

BACKGROUND

In the resource recovery and fluid sequestration industries Expandable liner hangers are used in many systems but sealing them has always been difficult. The art is always receptive to improvements in function and reliability.

SUMMARY

An embodiment of a seal arrangement for a liner hanger, including a seal ring, a lock ring adjacent the seal ring, the lock ring including a body having an axial dimension, and a radial dimension configured to limit radial compression of the seal ring, during use, a wing extending from the body in an axial direction of the body, and a shoulder defined by the body, the shoulder complementary to a lock member.

An embodiment of a liner hanger, including a tubular, a plurality of seal rings disposed on the tubular, a plurality of lock rings alternatingly disposed with the plurality of seal rings on the tubular, the lock rings each including a body and a wing extending from the body, the wing at least partially covering an adjacent seal ring of the plurality of seal rings prior to setting of the arrangement, and a plurality of lock members interacting with the plurality of lock rings and the tubular to axially restrain the plurality of seal rings and plurality of lock rings on the tubular.

An embodiment of a method for assembling a seal arrangement, including positioning a lock ring on a tubular, positioning a seal ring on the tubular, repeating the positioning of a lock ring and the positioning of the seal ring until a selected number of lock rings and seal rings are alternatingly disposed on the tubular, and feeding a lock wire through a lock wire window to engage the tubular and the lock ring to retain the lock ring axially to the tubular.

An embodiment of a method for assembling a seal arrangement, including positioning a lock ring on a tubular, positioning a seal ring on the tubular, repeating the positioning of a lock ring and the positioning of the seal ring until a selected number of lock rings and seal rings are alternatingly disposed on the tubular, and wherein the positioning of the lock ring includes threading a first portion of the lock ring to a second portion of the lock ring one another on the tubular.

An embodiment of a borehole system, including a borehole in a subsurface formation, a string in the borehole, and a seal arrangement disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
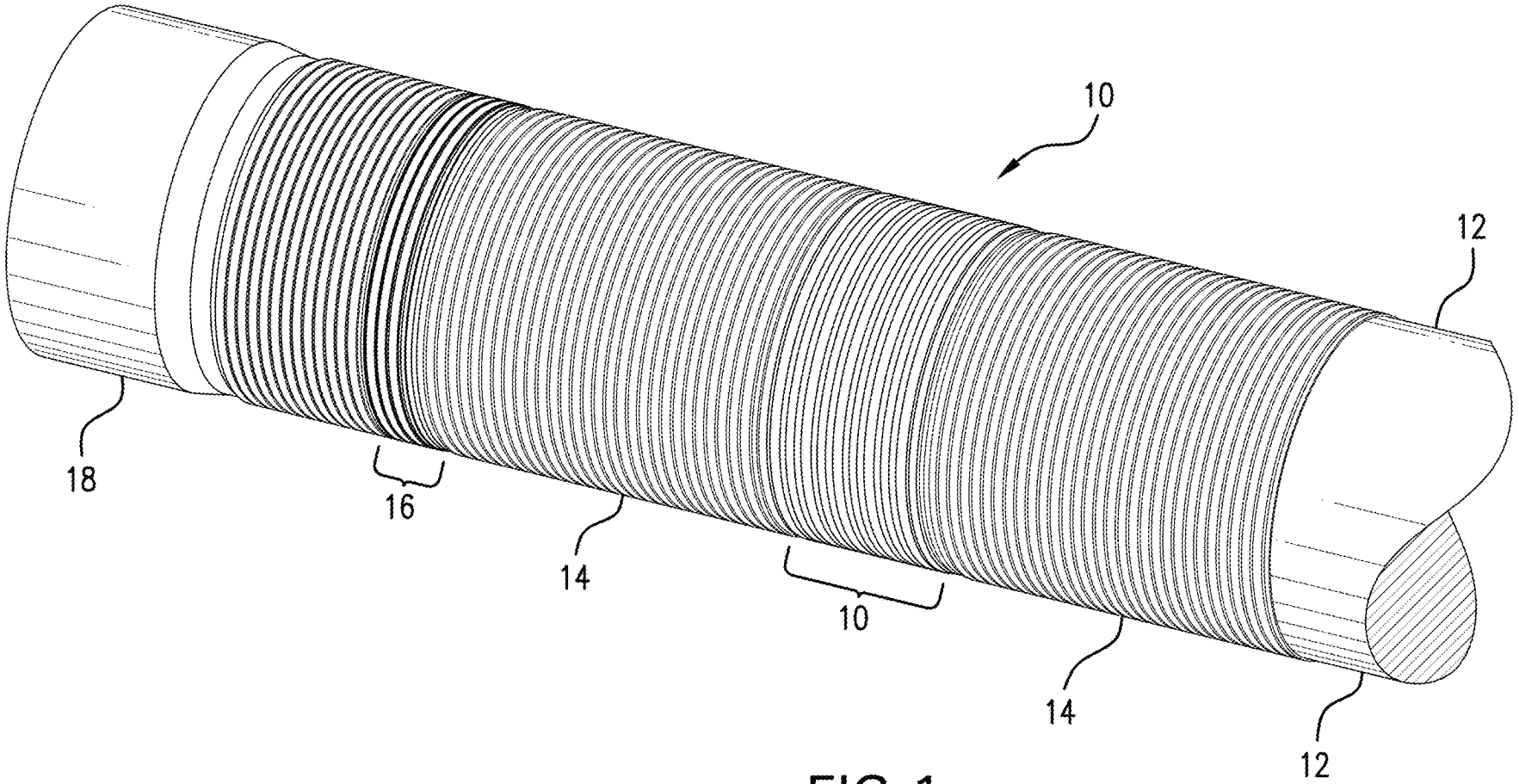
FIG. 1 is a perspective view of an expandable liner hanger system including the seal arrangement disclosed herein.
Figure 2:
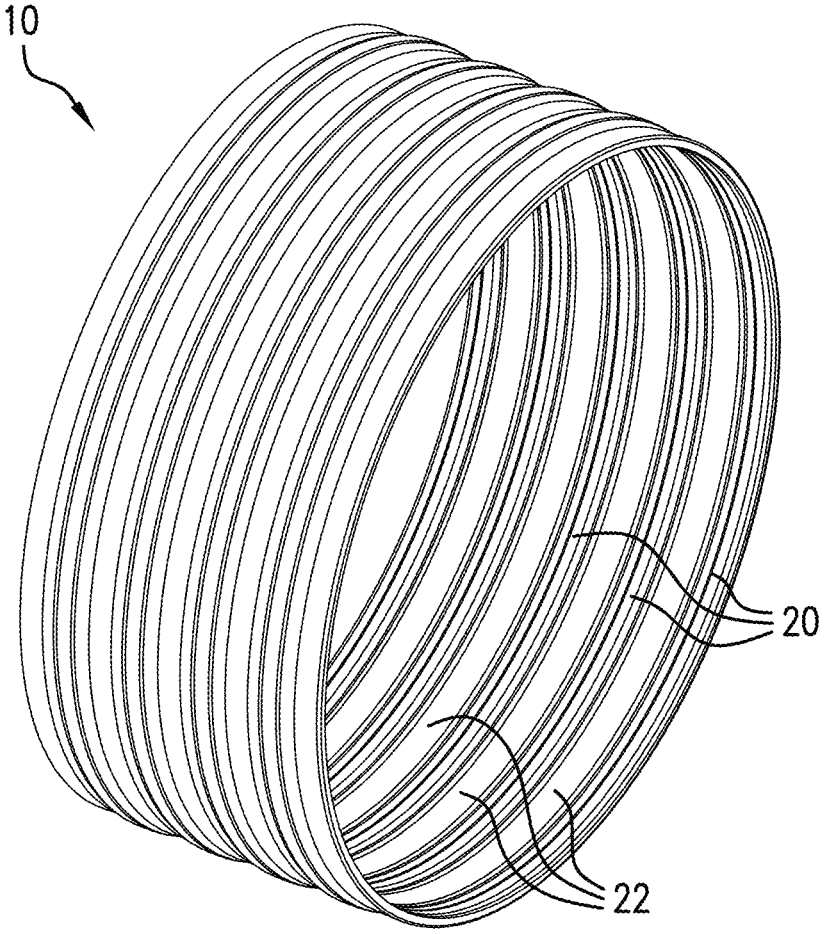
FIG. 2 is a perspective view of the seal arrangement disclosed herein.
Figure 3:
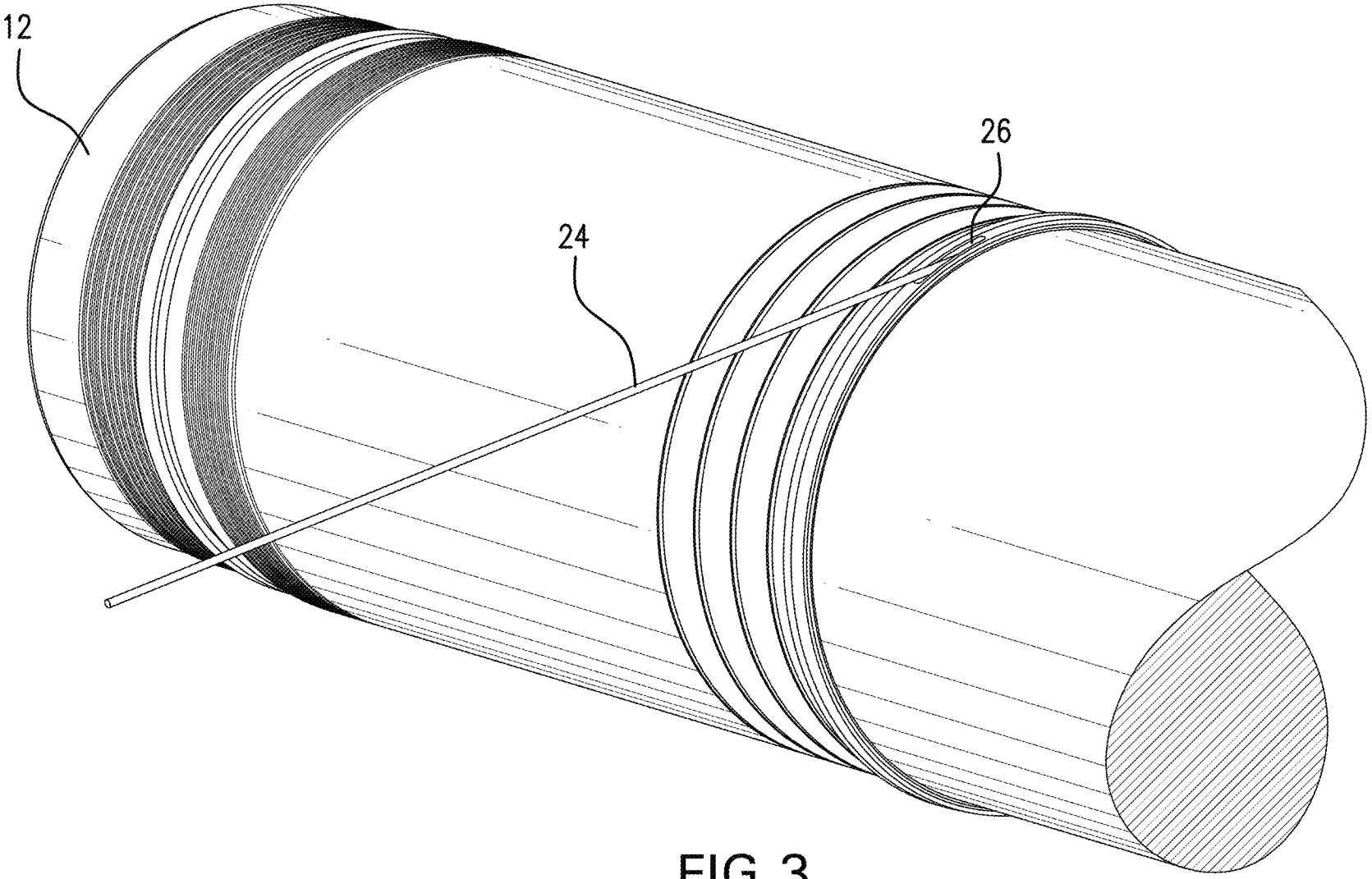
FIG. 3 is a perspective view of the system illustrating the insertion of a wire lock.

Referring to FIG. 1, a seal arrangement 10 is illustrated on a tubular member 12. In an embodiment the tubular member is a liner hanger body and the whole system is useful in an embodiment for a liner hanger function. The liner hanger also may include a slip 14, stop ring 16, and a cross over 18. The seal arrangement 10 is illustrated in perspective view separated from the tubular 12 in FIG. 2 for clarity, includes a plurality of lock rings 20 and a plurality of seal rings 22. These are best observed in FIGS. 4-6 but are illustrated from a system level view in FIGS. 1 and 2. The lock rings 20 are restrained to the tubular 12 mechanically with two embodiments being illustrated. In the first embodiment, a lock member 24 that is configured as a wire or similar flexible is fed through a wire port 26 to rest partially in a groove 28 in an outside surface 30 of the tubular 12 and partially in a recess 32 of the lock ring 20, that recess exhibiting a shoulder 34. Insertion of the lock member 24 is illustrated in FIG. 3. The restraining effect can be appreciated well in FIGS. 4 and 5, which shows that the member 24 bridges the interface between the tubular 12 and the lock ring 20, thereby preventing axial movement of the lock ring 20 on the tubular 12.

Figure 4:
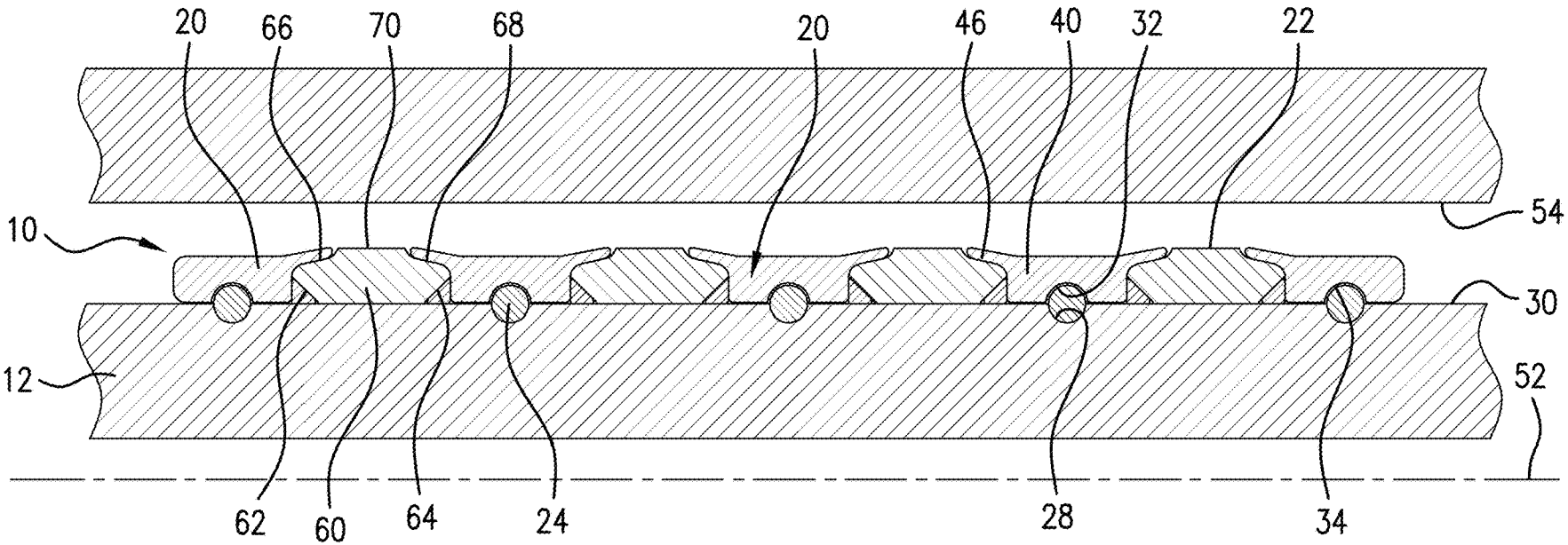
FIGS. 4-6 are a sequence of the seal arrangement in situ before, during, and after swaging.
Figure 7:
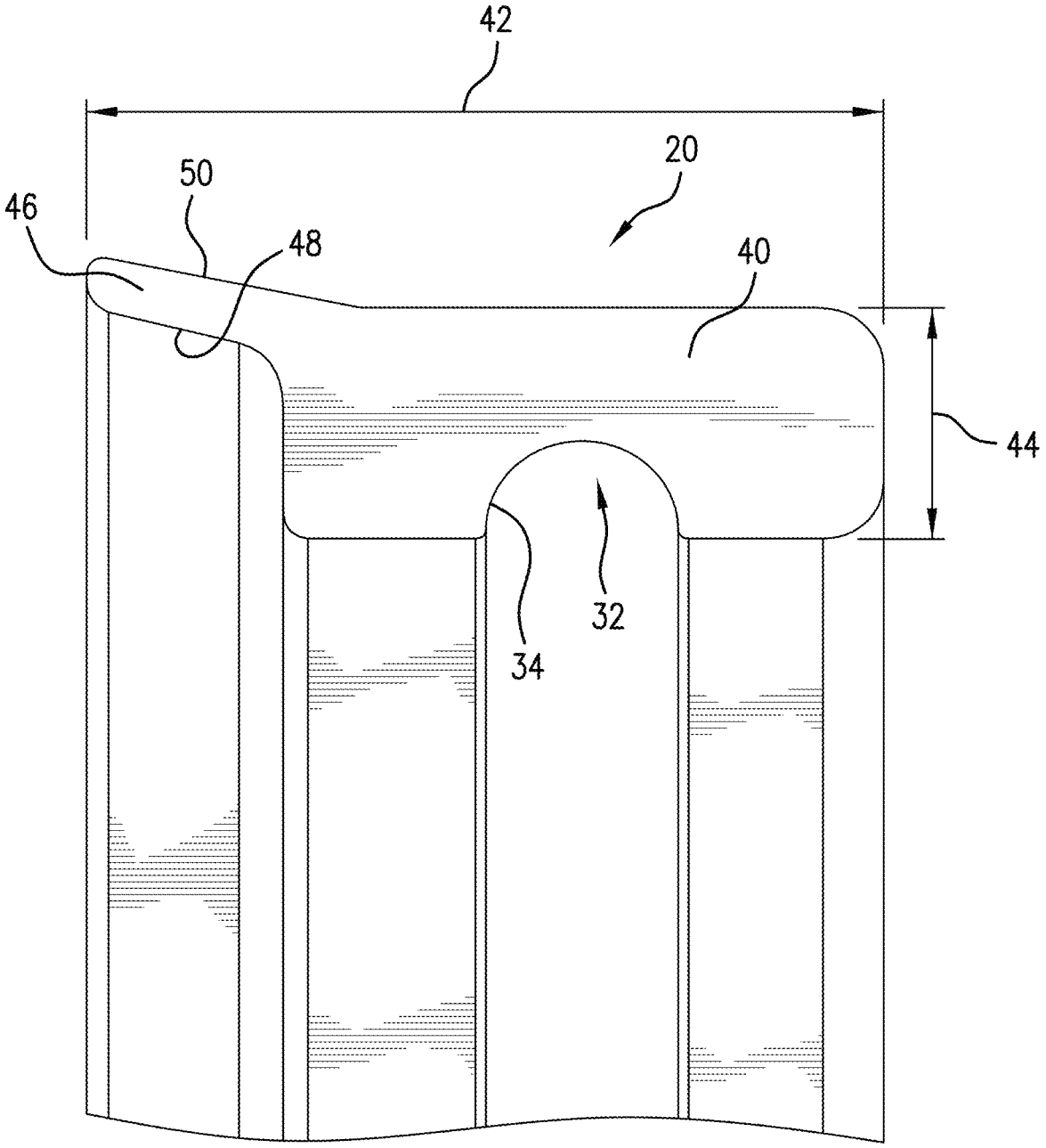
FIG. 7 is an enlarged view of one of the end lock rings that make up a part of the seal arrangement of FIGS. 1-6.

Referring to FIGS. 4 and 7, the particular features of the lock rings 20 are illustrated. Each lock ring 20 includes a body 40 having an axial dimension 42, and a radial dimension 44. The radial dimension is selected to limit radial compression of an adjacent seal ring 22. Each lock ring 20 also includes a wing 46 extending from the body 40 in an axial direction of the body 40. The wing 46 is defined by a radially inward surface 48 and a radially outward surface 50. The radially inward surface 48 is at an angle to an axis 52 of the lock ring 20 of in the range of about 11 degrees to about 15 degrees. The radially outward surface 50 is at an angle to an axis 52 of the lock ring 20 of in the range of about 8 degrees to about 12 degrees. It will be appreciated in FIGS. 4 and 7 that the wing 46 flares radially outwardly relative to the axis of the lock ring 20. This is beneficial as it causes the wing 46 to contact an inside surface 54 of a structure against which the seal arrangement 10 will be set first. The wing 46 then will deflect radially as the seal arrangement is forced to move radially outwardly as a whole. The wing 46 then ensures a tight contact to reduce the chances of seal ring 22 malfunction during and after setting. It is further noted that the wing 46, which of course may be on both axial ends of a lock ring depending upon whether or not there are seal rings 22 on one or both of those ends, will overhang the seal ring 22. The overhang of wing 46 on the seal ring 22, assists in reducing the possibility of swab off of the seal ring 22 during running and during flow past the seal arrangement prior to setting. Lock rings 20 may comprise metal or other material that has sufficient resilience and compressive resistance to support the function as described.

Referring to FIG. 4, the seal ring 22 is illustrated in cross section such that its shape in cross section can be ascertained. The shape is unconventional and hence for purposes of this disclosure will be termed a "polygoid", a made-up term specifically created to identify the specific shape illustrated and described herein. The polygoid shape comprises a base surface 60, angled surfaces 62 and 64 extending from the base surface 60 at an angle ranging from about 45 degrees to about 70 degrees. Cover surfaces 66 and 68 extend from the angled surfaces 62 and 64 at an angle generally matching the radially inward surface 48 of the lock ring 20. Finally, a crown surface 70 is about parallel to the base surface 60 and extends between the cover surfaces 66 and 68. At each intersection, there may in some embodiments be an optional radius of about 0.015 inch to about 0.030 inch. It will be appreciated that at angled surfaces 62 and 64, some embodiments of the seal arrangement 10 will include backups 72 and 74 having a substantially complementary angle to the angle of the angled surfaces 62 and 64. The polygoid shape provides for excellent resistance to swab off and to extrusion in combination with the lock rings 20 and backups 72 and 74.

Figure 5:
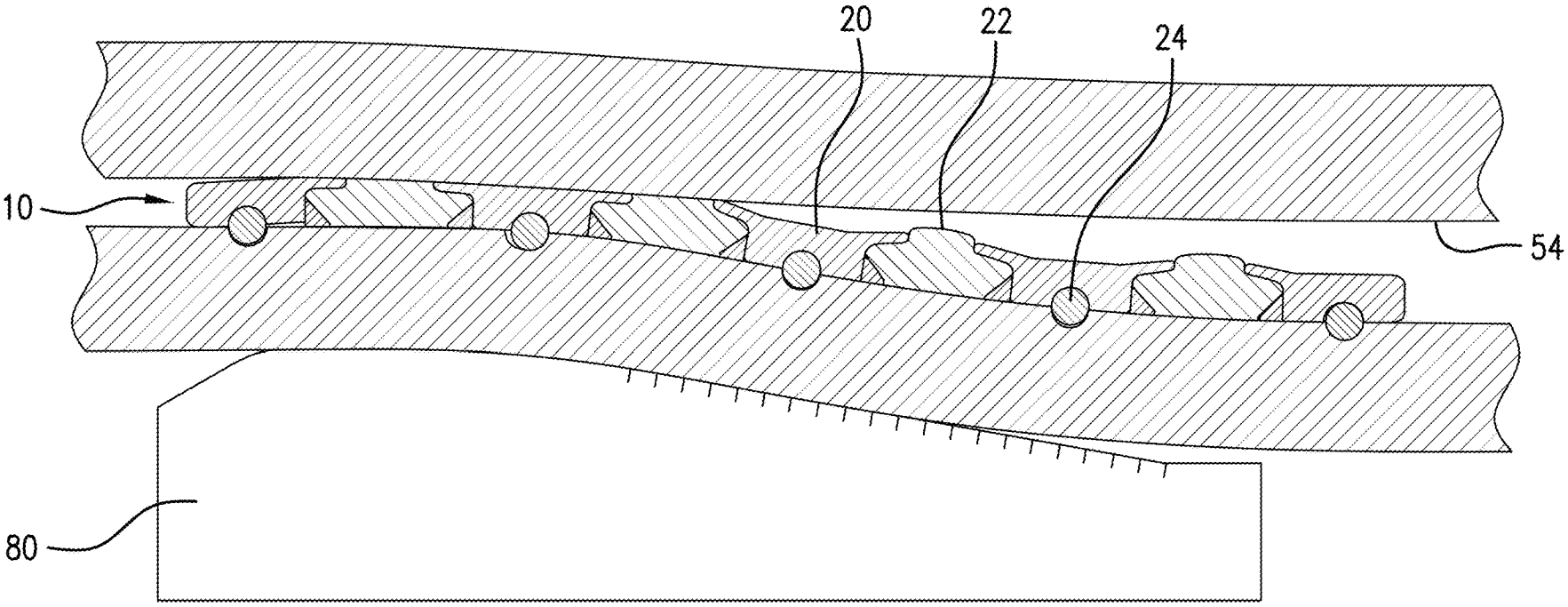
Figure 6:
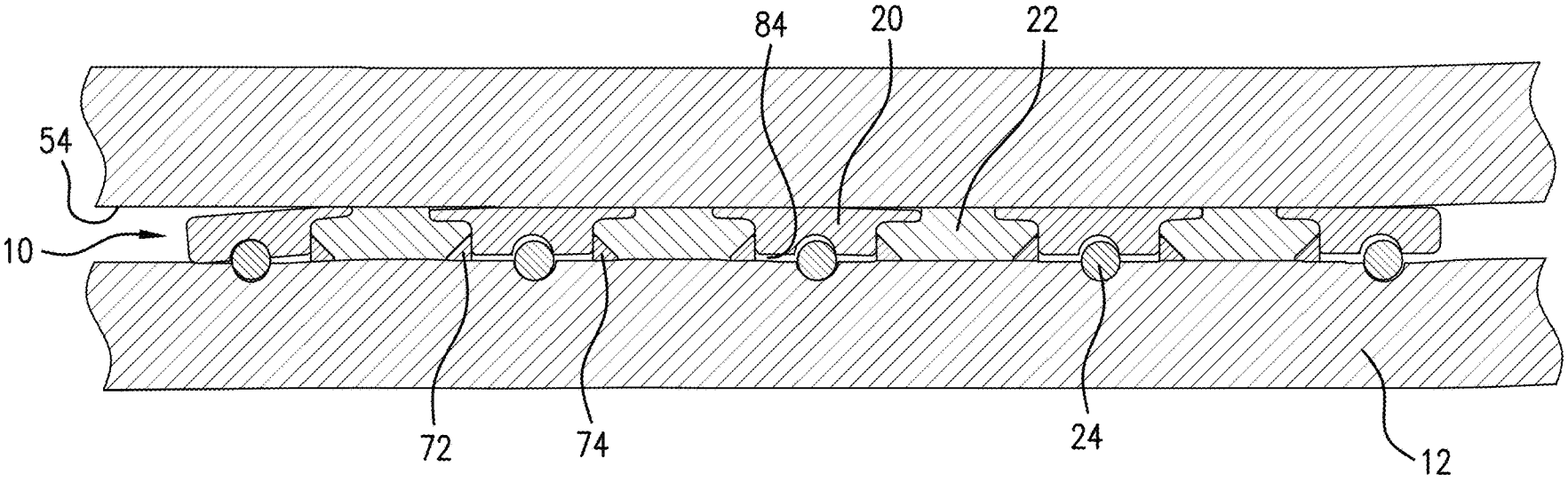

In use, referring to FIGS. 4-6, seal arrangement 10 is deformed into sealing condition by a swage 80 run through tubular 12. FIG. 4 shows the arrangement 10 in a running position, FIG. 5 illustrates the swage 80 part way through the swaging operation, and FIG. 6 illustrated the seal arrangement in a set position. In FIG. 5, it is evident how the lock members 24 help maintain the position of the seal arrangement 10 rather than allowing it to slide pursuant to the swaging operation. In FIG. 6, the seal rings 22 are optimally compressed in the annular space between surface 54 and tubular 12 to create a good seal by fully loading the lock ring bodies 40 and limiting further compression of the seal rings 22. It is also easy to appreciate the wings 46 deflecting in the view of FIG. 5 as a function of the swaging operation. In FIG. 6, it is illustrated that during the expansion process and loading against the surface 54, the lock rings tend to become slightly spaced from the tubular 12, resulting in gap 84. This is why it is desirable in some embodiments to include backups 72 and 74 since they bridge the gap 84 and reduce the potential for extrusion of the seal ring 22 through that gap 84.

Figure 8:
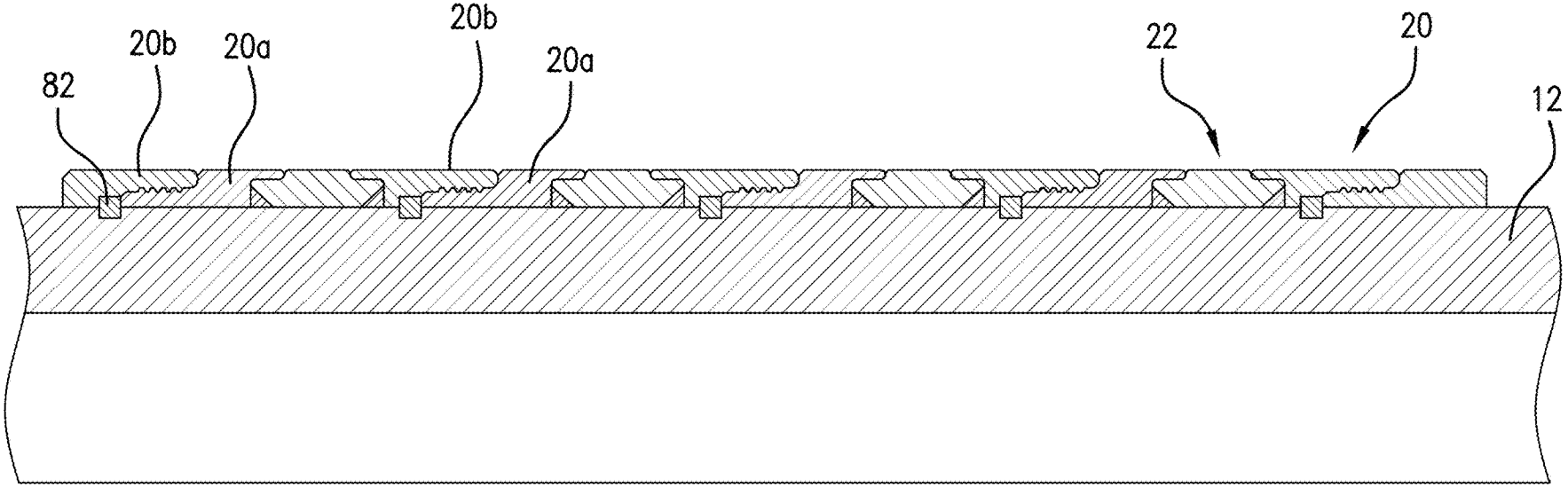
FIG. 8 is an alternate embodiment of the seal arrangement.

Referring to FIG. 8, an alternate seal arrangement 10 is illustrated that does not use a wire as a lock member 24 but rather the seal arrangement 10 is built one piece after the next on the tubular 12 starting with a first portion of a lock ring 20, (first portion 20*a*) so a different kind of lock member 24 may be employed that does not require being fed into the groove through a port 26. For purposes of clarity this lock member will be numbered 82. Lock member 82 may be a snap ring, C ring, E ring, etc.) that may be placed on the tubular 12 after portion 20*a* is placed on the tubular 12 and then the next portion of the lock ring 20 (second portion 20*b*) is threaded to the first portion 20*a* of that lock ring 20. This action sandwiches the lock member 24 (ring 82) between the first portion 20*a* and second portion 20*b*. This will certainly prevent any axial motion of the lock ring 20 and hence the entire seal arrangement 10 on the tubular 12.

Figure 9:
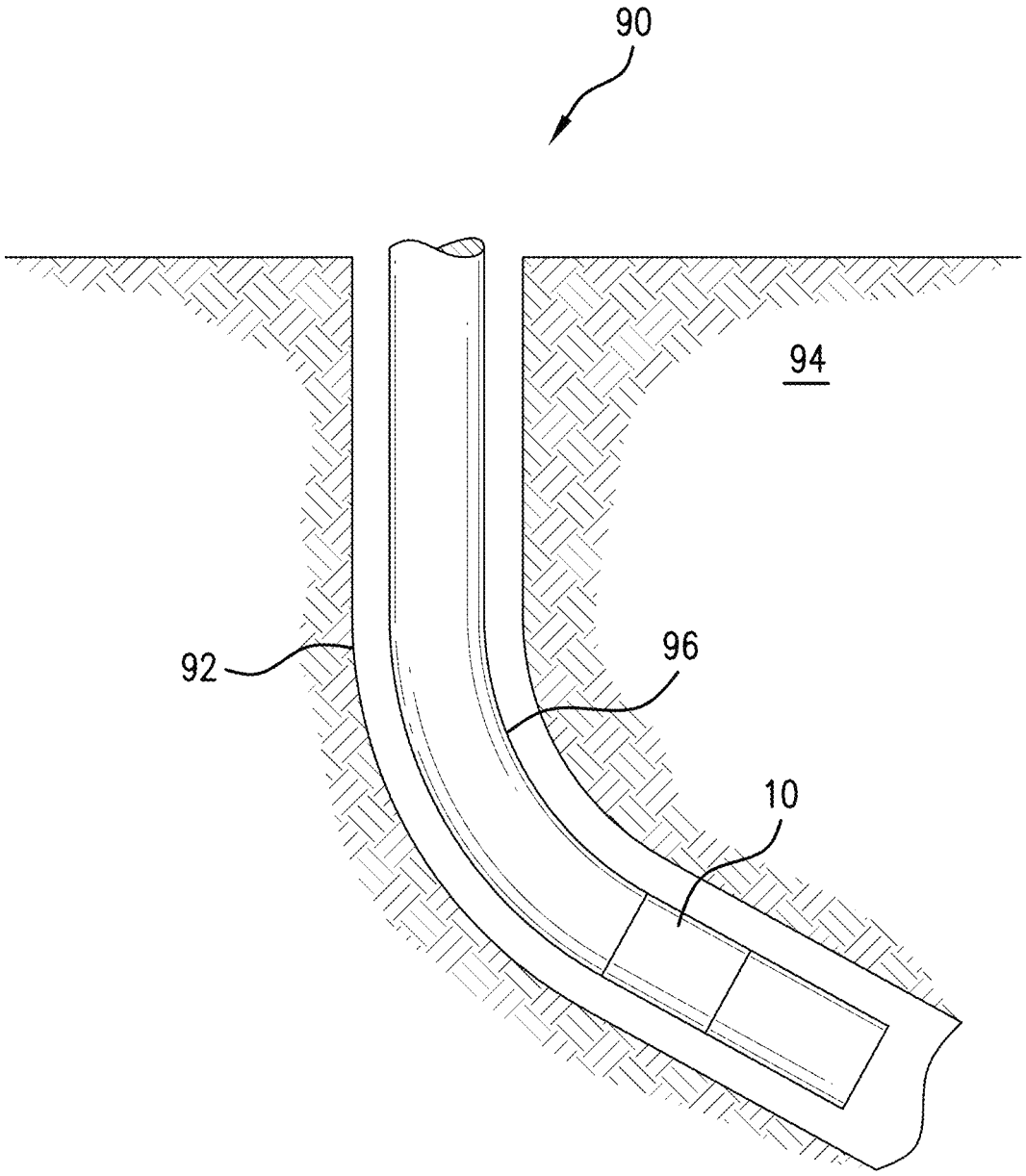
FIG. 9 is a view of a borehole system including the seal arrangement as disclosed herein.

Referring to FIG. 9, a borehole system 90 is illustrated. The system 90 comprises a borehole 92 in a subsurface formation 94. A string 96 is disposed within the borehole 92. A seal arrangement 10 as disclosed herein is disposed within or as a part of the string 96.

Set forth below are some embodiments of the foregoing disclosure:

Embodiment 1: A seal arrangement for a liner hanger, including a seal ring, a lock ring adjacent the seal ring, the lock ring including a body having an axial dimension, and a radial dimension configured to limit radial compression of the seal ring, during use, a wing extending from the body in an axial direction of the body, and a shoulder defined by the body, the shoulder complementary to a lock member.

Embodiment 2: The arrangement as in any prior embodiment, wherein the wing includes vectors of extension in both axial and radial directions of the body.

Embodiment 3: The arrangement as in any prior embodiment, wherein the wing is defined by a radially inward face and a radially outward face.

Embodiment 4: The arrangement as in any prior embodiment, wherein the radially inward face is at a range of angle from an axis of the lock ring of about 11 to about 15 degrees.

Embodiment 5: The arrangement as in any prior embodiment, wherein the radially outward face is at a range of angle from an axis of the lock ring of about 8 to about 12 degrees.

Embodiment 6: The arrangement as in any prior embodiment, wherein the shoulder is receptive to a lock member that is circular in cross section.

Embodiment 7: The arrangement as in any prior embodiment, wherein the shoulder is receptive to a lock member that is rectangular in cross section.

Embodiment 8: The arrangement as in any prior embodiment, wherein the seal ring is a polygoid in cross section.

Embodiment 9: The arrangement as in any prior embodiment, further including a backup.

Embodiment 10: The arrangement as in any prior embodiment, wherein the lock ring comprises two parts having complementary threads to one another.

Embodiment 11: A liner hanger, including a tubular, a plurality of seal rings disposed on the tubular, a plurality of lock rings alternatingly disposed with the plurality of seal rings on the tubular, the lock rings each including a body and a wing extending from the body, the wing at least partially covering an adjacent seal ring of the plurality of seal rings prior to setting of the arrangement, and a plurality of lock members interacting with the plurality of lock rings and the tubular to axially restrain the plurality of seal rings and plurality of lock rings on the tubular.

Embodiment 12: The arrangement as in any prior embodiment, further including a backup disposed between a seal ring of the plurality of seal rings and an adjacent lock ring of the plurality of lock rings.

Embodiment 13: A method for assembling a seal arrangement as in any prior embodiment, including positioning a lock ring on a tubular, positioning a seal ring on the tubular, repeating the positioning of a lock ring and the positioning of the seal ring until a selected number of lock rings and seal rings are alternatingly disposed on the tubular, and feeding a lock wire through a lock wire window to engage the tubular and the lock ring to retain the lock ring axially to the tubular.

Embodiment 14: A method for assembling a seal arrangement as in any prior embodiment, including positioning a lock ring on a tubular, positioning a seal ring on the tubular, repeating the positioning of a lock ring and the positioning of the seal ring until a selected number of lock rings and seal rings are alternatingly disposed on the tubular, and wherein the positioning of the lock ring includes threading a first portion of the lock ring to a second portion of the lock ring one another on the tubular.

Embodiment 15: The method as in any prior embodiment, further including capturing a lock member between the portions of the lock ring and the tubular.

Embodiment 16: A borehole system, including a borehole in a subsurface formation, a string in the borehole, and a seal arrangement as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A seal arrangement for a liner hanger, comprising:
a seal ring;
a lock ring adjacent the seal ring, the lock ring including:
a body having an axial dimension, and a radial dimension configured to limit radial compression of the seal ring, during use;
a wing extending from the body in an axial direction of the body, the wing overlapping the seal ring axially with the wing being radially outwardly of the seal ring; and
a shoulder defined by the body, the shoulder complementary to a lock member.

2. The arrangement as claimed in claim 1, wherein the wing includes vectors of extension in both axial and radial directions of the body.

3. The arrangement as claimed in claim 2, wherein the wing is defined by a radially inward face and a radially outward face.

4. The arrangement as claimed in claim 3, wherein the radially inward face is at a range of angle from an axis of the lock ring of about 11 to about 15 degrees.

5. The arrangement as claimed in claim 3, wherein the radially outward face is at a range of angle from an axis of the lock ring of about 8 to about 12 degrees.

6. The arrangement as claimed in claim 1, wherein the shoulder is receptive to the lock member that is circular in cross section.

7. The arrangement as claimed in claim 1, wherein the shoulder is receptive to the lock member that is rectangular in cross section.

8. The arrangement as claimed in claim 1, wherein the seal ring is a polygoid in cross section.

9. The arrangement as claimed in claim 1, further including a backup.

10. The arrangement as claimed in claim 1, wherein the lock ring comprises two parts having complementary threads to one another.

11. A liner hanger, comprising:
a tubular;
a plurality of seal rings disposed on the tubular;
a plurality of lock rings alternatingly disposed with the plurality of seal rings on the tubular, the lock rings each including a body and a wing extending from the body, the wing radially outwardly at least partially covering an adjacent seal ring of the plurality of seal rings prior to setting of the arrangement; and
a plurality of lock members interacting with the plurality of lock rings and the tubular to axially restrain the plurality of seal rings and plurality of lock rings on the tubular.

12. The arrangement as claimed in claim 11, further including a backup disposed between a seal ring of the plurality of seal rings and an adjacent lock ring of the plurality of lock rings.

13. A method for assembling a seal arrangement as claimed in claim 1, comprising:
positioning a lock ring on a tubular;
positioning a seal ring on the tubular;
repeating the positioning of a lock ring and the positioning of the seal ring until a selected number of lock rings and seal rings are alternatingly disposed on the tubular; and
feeding a lock wire through a lock wire window to engage the tubular and the lock ring to retain the lock ring axially to the tubular.

14. A method for assembling a seal arrangement as claimed in claim 1, comprising:
positioning a lock ring on a tubular;
positioning a seal ring on the tubular;
repeating the positioning of a lock ring and the positioning of the seal ring until a selected number of lock rings and seal rings are alternatingly disposed on the tubular; and
wherein the positioning of the lock ring includes threading a first portion of the lock ring to a second portion of the lock ring one another on the tubular.

15. The method as claimed in claim 14, further including capturing a lock member between the portions of the lock ring and the tubular.

16. A borehole system, comprising:
a borehole in a subsurface formation;
a string in the borehole; and
a seal arrangement as claimed in claim 1 disposed within or as a part of the string.

* * * * *